United States Patent [19]

Briesemeister

[11] Patent Number: 4,974,859

[45] Date of Patent: Dec. 4, 1990

[54] BROADHEAD ARROWHEAD

[76] Inventor: Richard A. Briesemeister, Rt. 2, P.O. Box 128, Clear Lake, Wis. 54005

[21] Appl. No.: 519,954

[22] Filed: May 7, 1990

[51] Int. Cl.[5] ..... F42B 6/08

[52] U.S. Cl. ..... 273/422

[58] Field of Search ..... 273/422, 421

[56] References Cited

U.S. PATENT DOCUMENTS

| | | | |
|---|---|---|---|
| 2,909,372 | 10/1959 | Neri | 273/422 |
| 4,349,202 | 9/1982 | Scott | 273/422 |
| 4,468,038 | 8/1984 | Saunders | 273/422 |

*Primary Examiner*—Paul E. Shapiro

*Attorney, Agent, or Firm*—Peterson, Wicks, Nemer & Kamrath

[57] ABSTRACT

An arrowhead (10) is shown in the most preferred form including first and second blades (12, 14), a ferrule (16), and a collar (18). The leading ends of the blades (12, 14) are interconnected by slideably interlocking the blades (12, 14) together in slots (54, 58) formed in the blades (12, 14). The trailing ends of the blades (12, 14) are held in slots (62, 64) formed in the collar (18). The ferrule (16) is rotatably received in U-shaped sockets (38) formed in the blades (12, 14) and through the collar (18) and is adjustable therewith by threads (66, 78) formed in the ferrule (16) and collar (18). By rotation of the ferrule (16) relative to the collar (18) and the blades (12, 14), an expansion force is placed on the blades (12, 14). The slots (62, 64) of the collar (18) have a size to flushly receive the trailing ends of the blades (12, 14). Further, the trailing end (60) of the collar (18) is tapered and complementary to locking edges (30, 32) formed on the trailing ends of the blades (12, 14). The collar end (60) and the locking edges (30, 32) are engaged and held by the internally tapering face (76) of an integral flange (74) formed on the ferrule (16), with the trailing ends of the blades (12, 14) being sandwiched and held between the collar (18) and the flange (74) for locking the blades (12, 14) in the slots (62, 64) for preventing axial, radial, or circumferential movement of the trailing ends of the blades (12, 14) relative to the ferrule (16). The ferrule (16) may include threads (72) for threadable receipt within an internally threaded bore formed in the leading end of the arrow shaft.

20 Claims, 1 Drawing Sheet

BROADHEAD ARROWHEAD

BACKGROUND

The present invention generally relates to arrowheads for arrows, particularly to broadhead arrowheads, and specifically to broadhead arrowheads formed from replaceable and interchangeable components.

Archery is a type of leisure activity having a very active following. There is a continual demand in the archery field for improved equipment including arrowheads for arrow shanks. Specifically, a need exists for arrowheads which are strong and durable even though of an assembled nature. Further, such arrowheads should allow ease of assembly to allow the use of replaceable and interchangeable components including blades allowing the cutting edges of the arrowhead to be sharpened or replaced. Furthermore, even though easily dissassembled by the user, such arrowheads should not fall apart in use even when hitting firm or solid objects such as bones. Additionally, such arrowheads should have a minimal weight ratio to allow use of heavier blades while minimizing the total weight. Likewise, such arrowheads should maximize the cutting edges of the blades and provide minimum resistance for maximum penetration.

SUMMARY

The present invention solves these demands and other needs in the archery field by providing, in the most preferred form, an arrowhead where the blades are held under an expansion force between the first and second ends of the blade relative to a ferrule which may be secured to the shank of an arrow.

It is thus an object of the present invention to provide a novel arrowhead for an arrow.

It is further an object of the present invention to provide such a novel arrowhead of the broadhead type.

It is further an object of the present invention to provide such a novel arrowhead having the blades held under as expansion force.

It is further an object of the present invention to provide such a novel arrowhead including replaceable and interchangeable components.

It is further an object of the present invention to provide such a novel arrowhead including a minimal number of components.

It is further an object of the present invention to provide such a novel arrowhead which may be easily assembled.

It is further an object of the present invention to provide such a novel arrowhead which is not prone to flying apart when hitting a target.

It is further an object of the present invention to provide such a novel arrowhead which has a minimal weight ratio.

It is further an object of the present invention to provide such a novel arrowhead allowing use of heavier blades while minimizing the total weight.

It is further an object of the present invention to provide such a novel arrowhead which is not dependent on the arrow shaft for maintaining the arrowhead intact.

It is further an object of the present invention to provide such a novel arrowhead having cutting edges for the full length of the arrowhead including the tip.

It is further an object of the present invention to provide such a novel arrowhead minimizing resistance for maximum penetration.

It is further an object of the present invention to provide such a novel arrowhead including interlocking blades supported by an interior ferrule.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figures 1, 2:
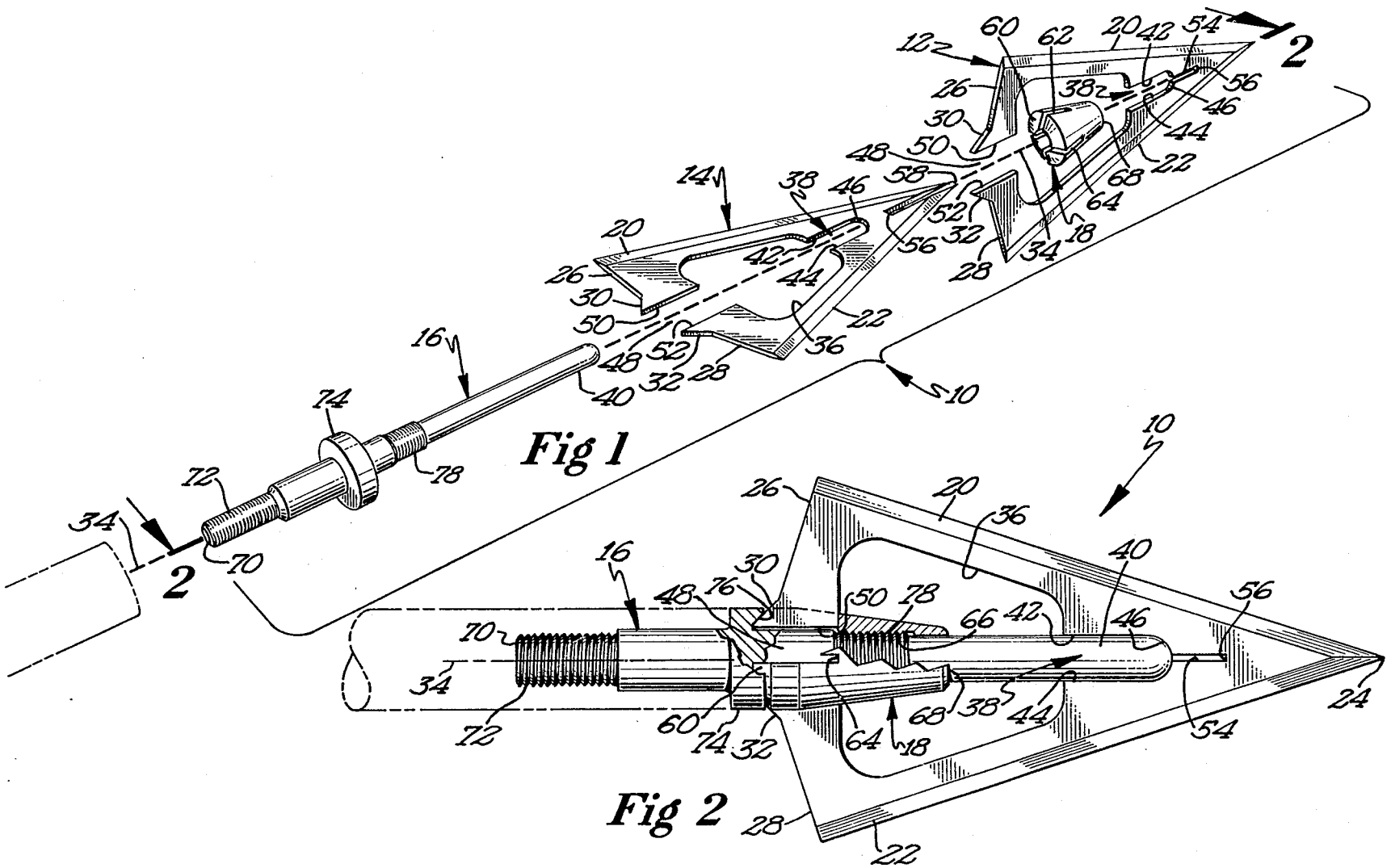
FIG. 1 shows an exploded, perspective view of a broadhead arrowhead according to the preferred teachings of the present invention.
FIG. 2 shows a cross sectional view of the assembled arrowhead of FIG. 1 according to section line 2—2 of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "leading", "trailing", "end", "axial", "radial", "side", "longitudinal", and similar terms are used herein, it should be understood that these terms have reference only to the structure shown in the drawings as it would appear to a person viewing the drawings and are utilized only to facilitate describing the invention.

DESCRIPTION

A broadhead arrowhead according to the preferred teachings of the present invention is shown in the drawings and generally designated 10. Arrowhead 10 in the most preferred form generally includes first and second, replaceable cutting blades 12 and 14, a ferrule 16, and a collar 18, Blades 12 and 14 in the most preferred form are of the same general size and configuration and specifically are thin, planar and wedge-shaped. Specifically, blades 12 and 14 include first and second sharpened, cutting edges 20 and 22 intersecting at a point 24 at the first, leading end of blades 12 and 14, with edges 20 and 22 extending at an angle in the order of 35°. The ends of edges 20 and 22 opposite point 24 intersect with back edges 26 and 28 at an angle in the order of 90° at the second, trailing end of blades 12 and 14. The ends of back edges 26 and 28 opposite edges 20 and 22 intersect with locking edges 30 and 32 at an angle in the order of 135°. Edges 20, 26, and 30 are mirror images of edges 22, 28, and 32 about a longitudinal axis 34 extending through point 24 of blades 12 and 14.

Blades 12 and 14 further include a central aperture 36 which is generally triangular shaped and diametric about axis 34. The leading ends of blades 12 and 14 include generally U-shaped sockets 38 extending from aperture 36 along axis 34 towards but spaced from point 24 for rotatably receiving leading end 40 of ferrule 16. In the preferred form, each socket 38 includes first and second, parallel sidewalls 42 and 44 located on opposite sides and diametric from axis 34 and which terminate in a tangential manner from a semicircular endwall 46. The trailing ends of blades 12 and 14 include a channel 48 extending from aperture 36 along axis 34 and intersecting with locking edges 30 and 32. In the preferred form, each channel 48 includes first and second, parallel sidewalls 50 and 52 located on opposite sides and diametric from axis 34.

Blades 12 and 14 may be interlocked together in any suitable manner such as in a perpendicular manner. In the preferred form, the leading end of blade 12 includes a slot 54 of a size to slideably receive the thickness of blade 14 and extending from endwall 46 of socket 38 along axis 34 to a point 56 spaced from point 24. The leading end of blade 14 includes a complementary slot 58 of a size to slideably receive the thickness of blade 12 and extending from point 24 to point 56 spaced from endwall 46 of socket 38. Thus, slot 58 of blade 14 may be positioned to extend through channel 48, aperture 36, socket 38, and slot 48 and be slid on blade 12 until point 56 of slot 58 of blade 14 abuts with point 56 of slot 54 of blade 12. With proper tolerancing of slots 54 and 58, blades 12 and 14 are tightly interlocked. It can be further appreciated that in the most preferred form, points 24 of blades 12 and 14 are generally adjacent to each other.

Collar 18 includes provisions for interlocking and holding blades 12 and 14 in position opposite points 24. In the preferred form, collar 18 includes a sleeve portion having slots 62 and 64 extending axially forward of trailing end 60 and which intersect with each other at angles corresponding to blades 12 and 14 interlocked at points 24 which in the preferred form are perpendicular to each other. Slots 62 and 64 have a length generally equal to the length of sidewalls 50 and 52 of channel 48. End 60 of collar 18 is tapered at the same angle and the same size as locking edges 30 and 32. Thus when blades 12 and 14 are received in slots 62 and 64 of collar 18, end 60 is flush and contiguous with locking edges 30 and 32 and blades 12 and 14 effectively fill slots 62 and 64. Collar 18 further includes a nut portion having internal threads 66 adjacent to end 68 opposite to end 60 of collar 18.

Trailing end 70 of ferrule 16 opposite to end 40 includes suitable provisions for securement to the leading end of an arrow shaft such as threads 72 for threadable receipt in an internally threaded bore formed in the leading end of the arrow shaft. Spaced from end 70, ferrule 16 further includes an integral, radially extending flange 74. Flange 74 in the preferred form has a diameter generally equal to. the diameter of locking edges 30 and 32 at their intersection with back edges 26 and 28 and in the most preferred form of end 60 of collar 18. The leading face 76 of flange 74 is tapered at an angle corresponding to and for receipt of locking edges 30 and 32 of blades 12 and 14 and end 60 of collar 18. Ferrule 16 further includes threads 78 for threadable receipt within threads 66 of collar 18, with threads 78 being located in front of flange 74 a distance generally equal to the distance that threads 66 are located in front of end 60 of collar 18. As previously set forth, end 40 of ferrule 16 in the most preferred form has a shape for slideable and rotatable receipt in sockets 38 of blades 12 and 14 and specifically includes a generally cylindrical portion which terminates in a semi-spherical end portion.

To assemble arrowhead 10 of the preferred form, the leading ends of blades 12 and 14 may be interconnected in a generally perpendicular manner by sliding blades 12 and 14 within slots 54 and 58. Collar 18 may be positioned generally centrally within apertures 36 of blades 12 and 14. Ferrule 16 may then be moved such that end 40 extends through channels 48 of blades 12 and 14, through collar 18, and into sockets 38 of blades 12 and 14. Collar 18 may be rotated about ferrule 16 until slots 62 and 64 are aligned with blades 12 and 14 and then may be slid on ferrule 16 until threads 78 of collar 18 engage threads 66 of ferrule 16. At that time, ferrule 16 may be rotated within sockets 38, blades 12 and 14, and collar 18 threadably engaging threads 66 and 78. It can then be appreciated that rotation of ferrule 16 causes collar 18 to move rearwardly on ferrule 16 and sliding blades 12 and 14 further into slots 62 and 64 until blades 12 and 14 engage the axial ends of slots 62 and 64 and end 40 of ferrule 16 abuts with endwalls 46 of sockets 38. Upon continued rotation of ferrule 16, collar 18 pushes against the trailing ends of blades 12 and 14 stretching and placing an expansion force on blades 12 and 14. Ferrule 16 may be continued to be rotated until locking edges 30 and 32 of blades 12 and 14 and end 60 of collar 18 abut with and ar tightened against face 76 of flange 74. The assembled arrowhead 10 may be secured to an arrow shaft by utilizing threads 72 in the normal manner.

It can be appreciated that the distance of face 76 of flange 74 from end 40 of ferrule 16 is complementary to the size of blades 12 and 14 to place blades 12 and 14 under the desired expansion forces when face 76 is tightened against locking edges 30 and 32 and end 60. It can be further appreciated that the second, trailing ends of blades 12 and 14 are held firmly in position relative to ferrule 16. Specifically, blades 12 and 14 are sandwiched by ferrule 16, collar 18, and flange 74. In particular, axial movement is prevented by blades 12 and 14 abutting with the axial ends of slots 62 and 64 and face 76 of flange 74. Circumferential movement is prevented by blades 12 and 14 being slideably received and abutting with the sides of slots 62 and 64. Radial movement is prevented by sidewalls 50 and 52 of channel 48 abutting with ferrule 16 and by locking edges 30 and 32 abutting with face 76 of flange 74. Further, it can be appreciated that the leading ends of blades 12 and 14 being interlocked and end 40 of ferrule 16 being piloted in sockets 38 arranged perpendicularly in the preferred form allow blades 12 and 14 and ferrule 16 to support each other and are not susceptible to undesired separation.

Now that the basic construction of arrowhead 10 according to the preferred teachings of the present invention has been explained, subtle features and further advantages of arrowhead 10 can be set forth and appreciated. Specifically, prior arrowheads typically placed the blades under compression forces. It can be appreciated that an arrowhead hitting an object also places the blades under compression forces. Thus, prior arrowheads utilizing compression forces were prone to flying apart in use and especially when engaging firm objects such as a bone in a target animal. Thus, prior arrowheads require more material (and thus weight) to achieve the strength required to prevent flying apart in use. Arrowhead 10 according to the teachings of the present invention places blades 12 and 14 under an expansion force which counters compression forces when points 24 engage a target. Thus, arrowhead 10 is of a stronger design. Arrowhead 10 according to the teachings of the present invention allows use of heavier blades while still minimizing the total weight and while providing a strong, rigid assembly.

Further, prior arrowheads often utilized the tightening of the arrowhead into the arrow shank to provide the compression force which held the arrowhead together. This is disadvantageous for several reasons. For example, the compression force is then dependent on the tolerances of both the arrowhead and the arrow shank and specifically on the distance that the arrowhead is threaded into the arrow shank. Further, when not attached to an arrow shank, prior arrowheads would simply slide apart which makes packaging and storage of such arrowheads more difficult. Arrowhead 10 according to the preferred teachings of the present invention is not dependent upon the arrow shaft to keep arrowhead 10 intact in an assembled condition. Thus, arrowhead 10 does not encounter the problems and disadvantages of prior arrowheads which utilized the tightening of the arrowhead into the arrow shank to hold the arrowhead together.

Further, arrowhead 10 according to the teachings of the present invention does not require the use of a punch type point which provides resistance for arrowhead penetration. Specifically, blades 12 and 14 in the preferred interconnected form provide point engagement minimizing contact area with the target to minimize resistance for arrowhead 10 entering the target and for maximizing penetration of arrowhead 10. Further, blades 12 and 14 include cutting edges 20 and 22 which extend the full length of arrowhead 10 including points 24. Further, material and weight at the tip of arrowhead 10 is minimized especially over prior punch type points.

Additionally, it can be appreciated that blades 12 and 14, ferrule 16, and collar 18 are replaceable and interchangeable in arrowheads 10 according to the preferred teachings of the present invention. Thus, for example, blades 12 and 14 may be removed and resharpened and placed in the same arrowhead or a different arrowhead.

Now that the basic teachings of the present invention have been explained, many extensions and variations will be obvious to one having ordinary skill in the art. For example, although blades 12 and 14 have been shown and described as being of generally the same size and configuration, blades 12 and 14 may have different sizes and/or configurations. One example would be to have blade 14 being sized 90% that of blade 12 and interconnected with point 24 of blade 14 spaced axially rearwardly from point 24 of blade 12 such that point 24 of blade 12 provides a chisel point for arrowhead 10.

Likewise, although two blades 12 and 14 are shown and described, an arroWhead 10 according to the teachings of the present invention may include fewer or more blades if desired. Similarly, blades 12 and 14 may be interconnected in different manners and arrangements according to the teachings of the present invention.

Furthermore, although the piloting of end 40 of ferrule 16 in sockets 38 of blades 12 and 14 held in a perpendicular manner is believed to be particularly advantageous including in reducing the number of pieces and in reducing weight, other manners of rotatably mounting ferrule 16 in blades 12 and 14 may be utilized according to the teachings of the present invention. For example, a separate, piloted nose piece may be provided, secured to blades 12 and/or 14 such as by a slot for slideable receipt of blades 12 and/or 14 and which rotatably receives end 40 of ferrule 16. Such a piloted nose piece would be especially desireable if only a single blade 12 and/or 14 were utilized in forming arrowhead 10 according to the teachings of the present invention.

Similarly, although arrowhead 10 in the preferred form includes only three basic components, it can be appreciated that arrowhead 10 may be manufactured utilizing more components according to the teachings of the present invention. For example, collar 18 may be formed as two pieces such as a sleeve including slots 62 and 64 and a separate nut including threads 66. A separate nut would allow all of the remaining components including ferrule 16 to remain stationery for assembling arrowhead 10 according to the teachings of the present invention. Thus, a separate nut would eliminate the requirement that end 40 of ferrule 16 be rotatable relative to blades 12 and 14. Likewise, flange 74 could be made separate from ferrule 16 such as for manufacturing reasons. Such a separate flange 74 could be held in position on ferrule 16 such as by abutment with an annular rib formed on ferrule 16 or by abutment with the arrow shank when arrowhead 10 is secured to the arrow shank, if desired.

Thus since the invention disclosed herein may be embodied in other specific forms without departing from the spirit or general characteristics thereof, some of which forms have been indicated, the embodiments described herein are to be considered in all respects illustrative and not restrictive The scope of the invention is to be indicated by the appended claims, rather than by the foregoing description, and all changes which come within the meaning and range of equivalency of the claims are intended to be embraced therein.

What is claimed is:

1. Arrowhead comprising, in combination: a ferrule having a leading end and a trailing end, with the trailing end of the ferrule including means for securing the ferrule to the arrow shank of an arrow; a blade having a first end and a second end; and means for holding the blade relative to the ferrule under an expansion force between the first and second ends of the blade.

2. The arrowhead of claim 1 wherein the holding means comprises, in combination: a collar moveably adjustable on the ferrule intermediate the leading and trailing ends of the ferrule, with the leading end of the ferrule abutting the blade adjacent to the first end of the blade, and with the collar abutting the blade adjacent to the second end of the blade.

3. The arrowhead of claim 2 wherein the collar is moveably adjusted by threads formed on the ferrule and internally of the collar and in threadable engagement.

4. The arrowhead of claim 3 wherein the holding means further comprises, in combination: means engaging the second end of the blade opposite to the collar for preventing radial movement of the second end of the blade.

5. The arrowhead of claim 4 further comprising, in combination: a second blade having a first end and a second end, with the second blade being interconnected to the first blade, and wherein the holding means includes means for holding the second blade relative to the ferrule under an expansion force between the first and seconds, ends of the second blade.

6. The arrowhead of claim 5 wherein the collar includes a sleeve having axially extending slots for slideably receiving the second ends of the first and second blades for interconnecting the first blade to the second blade.

7. The arrowhead of claim 6 wherein the preventing means comprises, in combination: locking edges extending from the second ends of the first and second blades; and means held in a stationary position on the ferrule for engaging the locking edges of the blades.

8. The arrowhead of claim 7 wherein the engaging means comprises a flange held in a stationary position on the ferrule.

9. The arrowhead of claim 8 wherein the flange is formed integrally with the ferrule.

10. The arrowhead of claim 7 wherein the sleeve and e collar are formed as one piece; and wherein the arrowhead further comprises, in combination: means for rotatably mounting the ferrule relative to the blades.

11. The arrowhead of claim 10 wherein the rotatably mounting means comprises a socket formed in the first end of the blade for rotatably receiving the leading end of the ferrule.

12. The arrowhead of claim 10 wherein the first blade includes a slot for slideably receiving the first end of the second blade and the second blade includes a slot for slideably receiving the first end of the first blade, with the first and second blades being interconnected by slideably receiving the blades in the slots.

13. The arrowhead of claim 12 wherein the first blade is of a shape and size generally the same as the shape and size of the second blade.

14. The arrowhead of claim 13 wherein the first and second blades are thin, planar and wedge shaped.

15. The arrowhead of claim 3 wherein the collar includes a sleeve having axially extending slots for slideably receiving the second end of the first blade.

16. The arrowhead of claim 15 wherein the sleeve and collar are formed as one piece; and wherein the arrowhead further comprises means for rotatably mounting the ferrule relative to the first blade.

17. The arrowhead of claim 2 wherein the holding means comprises, in combination: means engaging the second end of the blade opposite to the collar for sandwiching the second end of the blade therebetween.

18. The arrowhead of claim 17 wherein the sandwiching means comprises, in combination: locking edges extending from the second end of the first blade; and means held in a stationary position on the ferrule for engaging the locking edges of the first blade.

19. The arrowhead of claim 18 wherein the engaging means comprises a flange held in a stationary position on the ferrule.

20. The arrowhead of claim 1 further comprising, in combination: a second blade having a first end and a second end, with the second blade being interconnected to the first blade, and wherein the holding means includes means for holding the second blade relative to the ferrule under an expansion force between the first and second ends of the second blade.

* * * * *

UNITED STATES PATENT AND TRADEMARK OFFICE

CERTIFICATE OF CORRECTION

PATENT NO. : 4,974,859

DATED : December 4, 1990

INVENTOR(S) : Richard A. Briesemeister

It is certified that error appears in the above-identified patent and that said Letters Patent is hereby corrected as shown below:

On the title page;

Under "References Cited" insert:

--4,169,597 10/1979 Maleski 273 422

OTHER DOCUMENTS

"Bowhunter," 1989 Edition, pages 25, 29, 73, 78-81, 105, and 115

The Bohning Company, Ltd., "Broadheads" brochure featuring Blazer--

Column 4, line 27, cancel "ar" and substitute therefor --are--.

Column 5, line 56, cancel "arroWhead" and substitute therefor --arrowhead --.

Column 6, line 65, cancel "seconds," and substitute therefor --second--.

Column 7, line 14, cancel "e" and substitute therefor --the--.

Column 8, line 11, before "comprises" insert --further--.

Signed and Sealed this

Twelfth Day of May, 1992

*Attest:*

DOUGLAS B. COMER

*Attesting Officer*

*Acting Commissioner of Patents and Trademarks*